US005337966A

United States Patent [19]

Francis et al.

[11] Patent Number: 5,337,966

[45] Date of Patent: Aug. 16, 1994

[54] METHOD AND APPARATUS FOR THE REDUCTION AND CLASSIFICATION OF SOLIDS PARTICLES

[75] Inventors: Gordon G. Francis, Sunset; Richard W. Hebert, Iota, both of La.

[73] Assignee: Fluid Mills, Inc., Lafayette, La.

[21] Appl. No.: 46,644

[22] Filed: Apr. 13, 1993

[51] Int. Cl.[5] ..... B02C 23/38

[52] U.S. Cl. ..... 241/46.06; 241/80; 241/92; 241/162; 241/285.2

[58] Field of Search ..... 241/21, 22, 43, 46.01, 241/46.08, 92, 160, 162, 165.5, 154, 80, 46.06, 285.2

[56] References Cited

U.S. PATENT DOCUMENTS

| | | | |
|---|---|---|---|
| 2,577,152 | 12/1951 | Powers | 241/46.08 |
| 3,998,938 | 12/1976 | Szegvari . | |
| 4,018,567 | 4/1977 | La Point | 241/46.01 |
| 4,098,465 | 7/1978 | Meller . | |
| 4,509,696 | 4/1985 | Donaldson | 241/22 |
| 4,942,929 | 7/1990 | Malachosky . | |
| 4,974,781 | 12/1990 | Placzek | 241/21 |
| 5,109,933 | 5/1992 | Jackson . | |
| 5,129,469 | 7/1992 | Jackson . | |
| 5,205,500 | 4/1993 | Eide | 241/154 |

*Primary Examiner*—Richard K. Seidel
*Assistant Examiner*—Paul Heyrana
*Attorney, Agent, or Firm*—William W. Stagg

[57] ABSTRACT

A system and apparatus for size reduction and classification of solids particles to aid in their disposal. The system includes mixing the solids particles in a viscous liquid to form a slurry in a receiving tank, passing the slurry through a series of initial screens and magnets, and circulating the slurry through a series of reduction tanks to a holding tank by vertical fluid mills. The vertical fluid mills include a slurry inlet and outlet and have a rotating shaft to which is mounted a series of rotating perforated disks which rotate in close proximity to and between a pair of stationary blades. The disks and blades are situated between series of impellers mounted on the rotating shaft. The reduction tanks include screens for solids classification and recirculation of the solids particles.

20 Claims, 3 Drawing Sheets

METHOD AND APPARATUS FOR THE REDUCTION AND CLASSIFICATION OF SOLIDS PARTICLES

FIELD OF INVENTION

The present invention generally relates to reducing the size of solid particles by wet grinding and, more particularly, is concerned with apparatus and method for classifying and grinding solid particles such as sand, sludge, shale, scale and rust to a particular size to facilitate their disposal.

BACKGROUND OF INVENTION

In recent years there has been a substantial interest in environmentally safe disposal of the by products produced as a result of industrial activities. Industrial activities, such as the drilling of oil and gas wells, may produce large volumes of material solids such as shale, sand and gravel as a natural by-product of the activity. Other industrial operations may produce sludge containing such solids as rust and scale as a component. These solids increase the difficulty and the expense of environmentally safe disposal of these by-products. Oil and gas well drilling operations also expose to the surface naturally occurring radioactive material known as NORM from the sub-surface geological formations. The presence of NORM proposes additional environmental and disposal problems.

Typical solids disposal methods include encapsulating the solids for landfills, bulk land filling, storage pits or injecting the solids into abandoned or new wells. The disposal is complicated by the volume and size of the solid particles being encountered. Thus, there is a need for techniques aimed at improving and simplifying the methods used to reduce the size and volume of the solids by products to aid in their disposal.

One method of disposal of solids such as drill cuttings from oil and gas well drilling activities has been described and illustrated in U.S. Pat. No. 4,942,929 to Malachosky, et al. The Malachosky patent discloses a method wherein construction grade gravel is separated from the spent drilling fluid for use as a construction material. The solids not reclaimed for construction use are formed into a slurry and conducted by pumps into an injection well for disposal into subterranean formations. This system has serious drawbacks in that it offers no way to mechanically reduce particle size prior to their injection into the injection well and its subterranean formations. Oversized particles may block the formation pore spaces and impede the flow of the solids into these formations. Further, NORM materials may not be suitable for construction use and may be of a size too large for injection disposal.

Another method to reduce the size and dispose of drill cuttings from oil and gas well drilling operations is disclosed in U.S. Pat. Nos. 5,109,933 and 5,129,469 to James E. Jackson. The Jackson patents disclose a method and system wherein the drill cutting solids are removed from the drilling fluid, conveyed to a shearing and grinding system that converts the cuttings into a slurry with the addition of water. The solid particles are reduced in size by means of a centrifugal pump and the viscous slurry is discharged into an injection pump for high pressure injection into an underground formation. The Jackson system, or variations of it, has been used extensively in the oil and gas industry for disposal of drill cuttings and drilling fluids. However, the Jackson system does have serious drawbacks.

One major drawback of Jackson is that it affords no control over the size of the solids particles that are being reduced. Without size controls, there is a tendency for the pore spaces of the underground formations to be clogged by oversized solids particles when they are injected into the disposal well. Another is that the solids reduction is accomplished by mixing the solids with a carrier liquid and then transporting the mixture to a conventional centrifugal pump which serves to reduce the size of the solids particles as they circulate through the centrifugal pump. The Jackson system requires that the pump turn at an accelerated speed over and above its normal operating speed. This circulation and recirculation at accelerated pump speeds can cause great wear and tear on the centrifugal pumps and on the pump motors which ultimately leads to downtime on the system and additional expense due to the need for increased repair, maintenance and replacement of the pumps and motors.

Another method and apparatus for wet grinding particle solids is illustrated in U.S. Pat. No. 3,998,938 to Andrew Szegvari. The Szegvari patent discloses a system having a pump to repeatedly circulate liquid suspended solids though a comminuting chamber. The Szegvari comminuting chamber has grinding elements comprised of arms or bars on a rotating shaft within the chamber and a grinding media, such as balls or pebbles, through which the liquid suspended solids pass. The rate of fluid flow through the comminuting chamber is 50 to 300 chamber volumes per hour. This system requires the repeated circulation of the fluid volume through the comminuting chamber with the means outside pumps to accomplish the grinding. Further, the chamber volume and its grinding capacity is limited by the presence of the required grinding media.

Another wet grinding device is that disclosed in U.S. Pat. No. 4,098,465 to Karl Heinz Meller, et al. Meller, et al describes a chamber to receive the material to be reduced along with a volume of grinding balls. The chamber has a plurality of grinding zones, and an auger type mixer which moves the solids material and the grinding balls along the auger, through the grinding zones to a discharge chute. Grinding of the solids is accomplished by the violent action of the grinding balls on the solids material as the solids material and balls are moved along the chamber. The volume of the device and its grinding capacity is limited by the additional volume of the grinding balls which are required in the material reduction process.

Consequently, a need exist for improvements in techniques to reduce the size of solids produced as by-products of industrial activities. This will facilitate disposal of these solids with a corresponding increase in efficiency and a decrease in cost of disposal.

SUMMARY OF INVENTION

The present invention provides a solids grinding and classifying apparatus and system designed to satisfy the aforementioned needs. It is contemplated for use in reducing the size of solids particles such as sand, sludge, shale, scale, gravel, earth, sewage and the like which have a size of three-quarters of an inch or less. Solids greater than three-quarters of an inch may require reduction to that size by other means before being introduced to the system. Solids having excessive hardness such as steel also may not be suitable for the system.

This system incorporates a series of unique grinding mills which serve both to simultaneously pump and grind a fluid mixture of solids suspended in a viscous slurry of water and bentonite. The unique mill has vertical array of impellers and a series of perforated rotating disks situated in close proximity to corresponding stationary blades to form the grinding elements. Solids particle reduction is accomplished as the slurry of suspended solids moves through the mill and the grinding elements by means of the impellers.

The system includes a means for classification of the solids to a maximum desired particle size. Classification is accomplished by routing the solids-slurry mixture through a series of barrel type and shaker type sieve classifiers. A series of tanks, each having the unique grinding mills, allow for circulation, grinding, classification and storage of the slurry mixture throughout the process. The finished solids-slurry mixture, having solids of the desired gradation, may be pumped or displaced into a conduit to be stored, injected into a well bore, run through a filtering system, or to any other type of remedial activity that requires reduction and classification of solids particles.

The unique fluid mill allows simultaneous grinding and circulation of the solids-slurry mixture through each stage of the process by employing as the grinding mills as self-sustained grinders and pumps.

DESCRIPTION OF PREFERRED EMBODIMENT(S)

Figure 1:
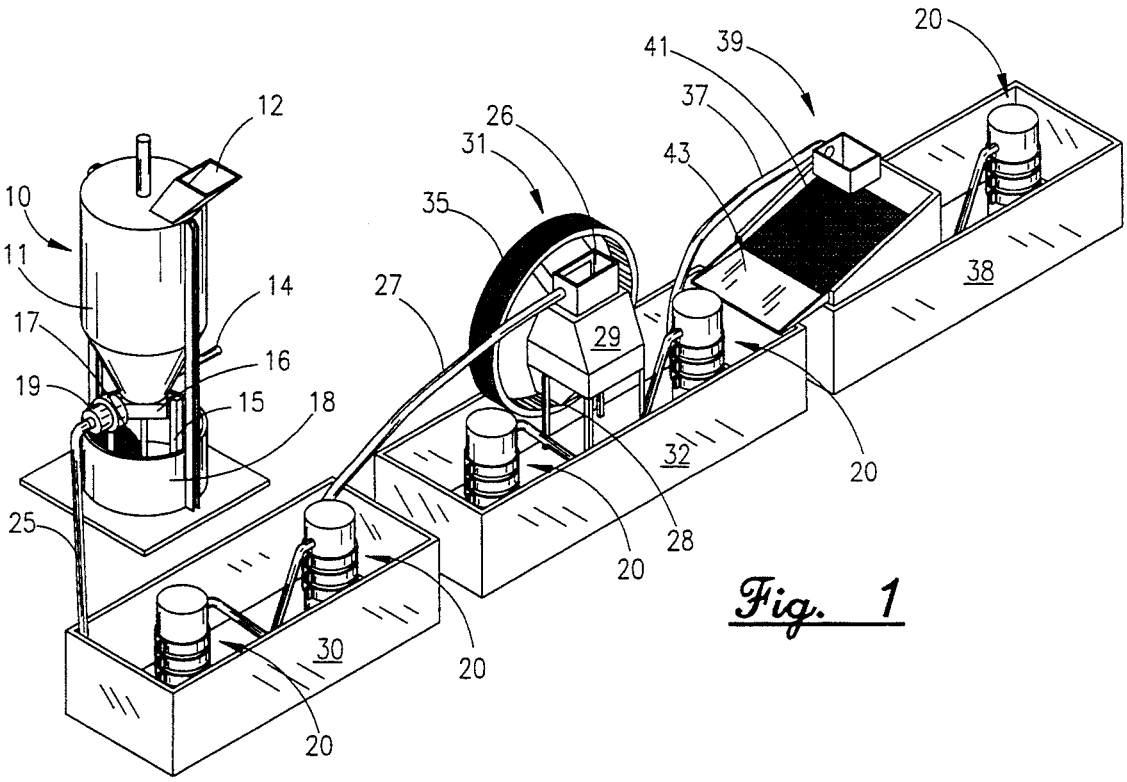
FIG. 1 is a schematic of the grinding and classifying system.

Referring now to the drawings and more particularly to FIG. 1 there is shown the preferred embodiment of the solids reducing and particle classifying system. The system is designed to receive sand, shale, gravel, earth, sludge, scale, sewage, composite and like solids of a size three quarters of an inch or less. Excessively hard solids such as steel are not suitable for processing in the system.

The system includes a slurry tank 10 having a receiving chamber 11 and a holding chamber 18. The receiving chamber 11 of slurry tank 10 has a dump chute 12 for receiving the solids to be reduced and an inlet 14 for receiving a solids transporting liquid. The solids transporting liquid is ideally a combination of bentonite and water mixed to form a slurry. Bentonite is used with water is for the slurry because it provides an increase in the specific gravity and the viscosity. The slurry suspends and lubricates the solids to facilitate the pumping and grinding process.

The receiving chamber 11 of slurry tank 10 has an outlet 16 to a holding chamber 18. The holding chamber 18 receives and retains the combined mixture of solids and the bentonite-water slurry. A circulating lift pump 19 moves the solids-slurry mixture from the holding chamber 18 through a series of magnets 15 and filter screens 17 to separate excessively large solids particles and ferrous metals from the slurry mixture. The solids-slurry mixture is then moved, via a conduit 25, into an initial grinding tank 30.

The solids slurry mixture is circulated within the initial grinding tank 30 by means of a unique vertical grinding mill 20 having a slurry inlet 21 at its base and a slurry exit conduit 23 at the top. Several grinding mills 20 may be utilized within the initial grinding tank 30. The number of grinding mills 20 required or desired is dependent upon the volume of solids sought to be processed and on physical properties of the solids such as hardness.

The solids-slurry mixture is circulated around the tank 30 and through the grinding mills 20 by the pumping action of the mills 20. As the solids-slurry mixture moves around the tank and through the mills 20, the solids are ground down by the action of the mills to reduce the size of the solids particles contained in the solids-slurry mixture. The solids-slurry mixture exits the mill 20 by means of a slurry exit conduit 23 directed to the bottom of the grinding tank 30 to allow for recirculation of the solid-slurry mixture around the tank 30 and through the mill 20.

As the volume of the solids-slurry mixture in the initial grinding tank 30 increases, excess mixture having the initially reduced solids particles is directed to an intermediate grinding tank 32 through a conduit 27 by the pumping action of the grinding mill 20. The intermediate grinding tank 32 contains a conventional wet grinder 29 and a barrel classifier 31. The grinder 29 has an upper receiving port 26 and a lower discharge port 28. The barrel classifier 31 has a rotating screen 35 having a screen mesh of a predetermined size. The barrel classifier 31 is arranged in combination with the wet grinder 29 so that the screen 35 of barrel classifier 31 rotates over the receiving port 26 and under the discharge port 28 of the grinder 29.

The solids-slurry mixture is introduced into the intermediate grinding tank 32 by the conduit 27 so that the mixture is first discharged into the receiving port 26 of the grinder 29 for further grinding of the solids particles. After this grinding, the solids-slurry mixture is discharged from the discharge port 28 of grinder 29 over the rotating screen 35 of the barrel classifier 31.

Undersized solids particles in the solids-slurry mixture are carried with the mixture through the mesh of the screen 35 into the intermediate tank 32. Oversized solids particles from the solids-slurry mixture are retained on the mesh of the rotating screen 35 and carried by the rotation of screen 35 over the receiving port 26 of the grinder 29 to fall into the grinder 29 for additional grinding along with the incoming solids-slurry mixture from conduit 27.

Wash water may be applied over the screen 35 to aid in removing the oversized solids particles from the screen mesh into the grinder 29. As the screen 35 rotates, the oversized solids particles are repeatedly circulated through the wet grinder 29 until they are sufficiently reduced in size to pass through the mesh of screen 35. The mesh of the screen 35 may be selected to classify the solids particles to a predetermined desired size.

The intermediate grinding tank 32 also contains additional grinding mills 20. The solids-slurry mixture that passes through the mesh of screen 35 is contained and temporarily held in intermediate tank 32. This retained mixture is circulated around the tank 32 and through the additional grinding mills 20 for further grinding and size reduction of the solids.

As the intermediate tank is filled with the solids-slurry mixture, the mixture is diverted by the mill 20 through a conduit 37 to an end stage grinding tank 38 having a shaker type classifier 39 and additional grinding mills 20. The shaker classifier 39 has an angled shaker screen 41 of a selected mesh size and an out fall chute 43 back to the intermediate grinding tank 32. The initial flow of solids-slurry mixture from conduit 37 is directed to the classifier 39 and over the shaker screen 41.

Shaker screen 41 retains and removes any solids particles from the solids-slurry mixture which are larger than the predetermined mesh of shaker screen 41. These retained solids particles are moved down the shaker screen 41 by gravity and the shaking action of the classifier 39 to the out fall chute 43 to fall back into the intermediate grinding tank 32.

The out fall solids particles from chute 43 are recirculated with the solids-slurry mixture in the intermediated tank 32 through the grinding mill 20 by the pumping action of the mill 20 and finally back to the shaker classifier 39 via conduit 37. The process is repeated until the solids particles are reduced to a size sufficient to pass through the mesh of shaker screen 41.

The final solids-slurry mixture, now having solids particles of a predetermined size, is collected in the end stage tank 38 for disposal. The final solids-slurry mixture is circulated through the additional grinding mills 20 to maintain suspension of the solids. The mixture may be tested for viscosity and solids suspension at this time. Should the solids particles fall out of suspension, additional bentonite or another viscosifier may be added to the slurry to maintain fluid viscosity and suspension of the solids particles as the mixture circulates through the mills 20.

Figure 2:
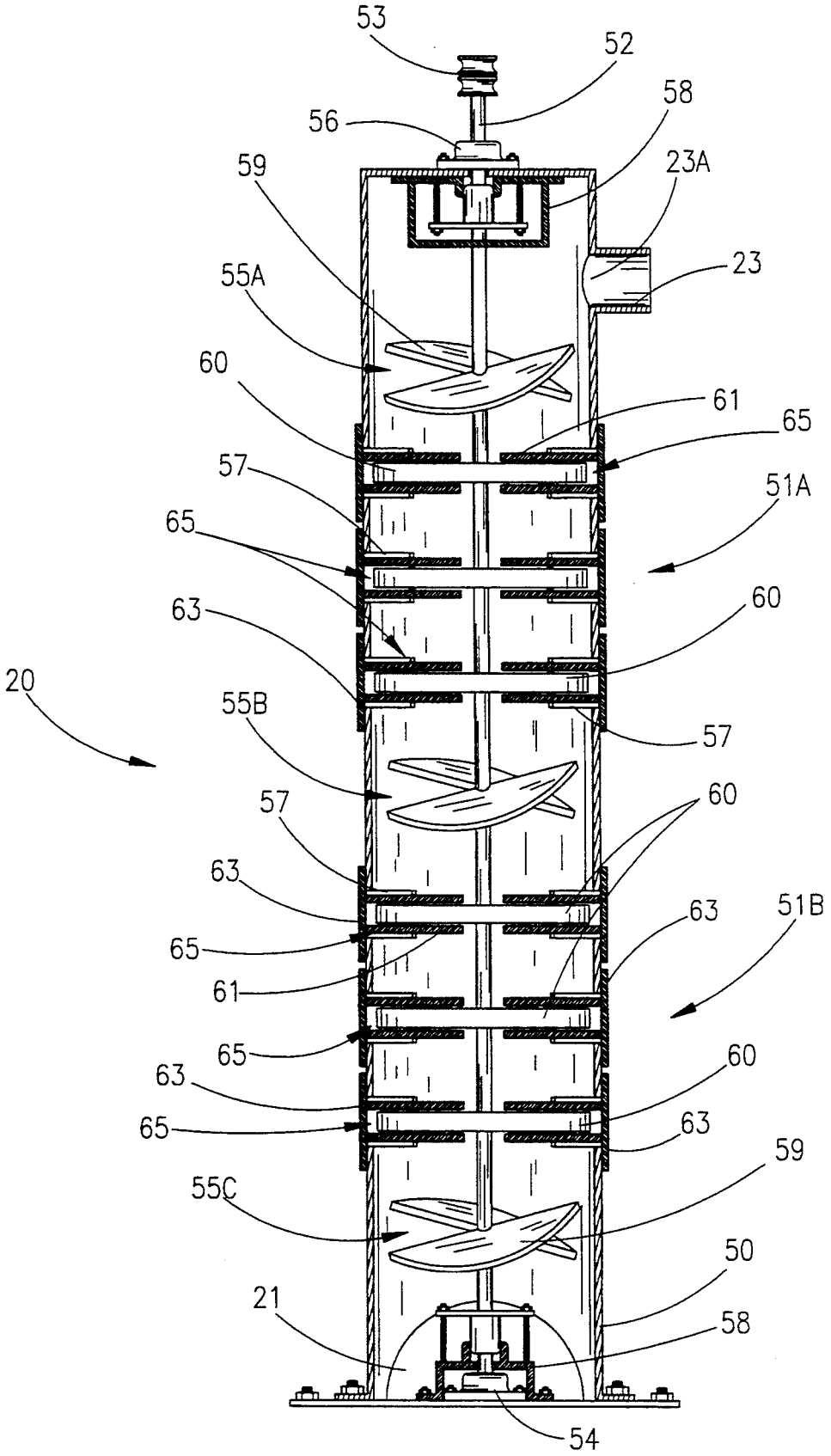
FIG. 2 is a cross-sectional view through the grinding mill.

Referring now to FIG. 2 there is shown in cross-section the preferred embodiment of the unique vertical grinding mill 20 for simultaneous grinding and pumping of the solids-slurry mixture. The mill 20 is comprised of a generally cylindrical housing 50 having a vertical array of grinding chambers and impeller chambers. An upper grinding chamber 51A and a lower grind chamber 51B are interposed between an upper impeller chamber 55A, an intermediate chamber impeller chamber 55B, and a lower impeller chamber 55C. A inlet 21 for the solids-slurry mixture is located at the base of the mill 20 and an outlet port 23A to conduit 23 for the mixture is located at the top of the mill 20 above the upper impeller chamber 55A.

A vertical rotating shaft 52 is centered within the housing 50 which is rotated by a rotating means 53, such as an electric motor, a driving belt or other means for rotating the shaft 52 a high speeds. The vertical shaft 52 is supported at the base of the mill 20 by a sealed, grease packed, fluid free bearing 54 and at the top of the mill 20 by a pillar bearing 56 on the outside of the housing 50. A stuffing box 58 protrudes into the housing 50 and around the shaft 52 and the pillar bearing 56 to protect the pillar bearing 56 from fluid infiltration.

Spaced longitudinally along each grinding chamber are a plurality of sleeves or openings 57 in the housing 50 to coincide with a plurality of circular disks 60 spaced longitudinally along the shaft 52 within grinding chambers 51A and 51B. The circular disks 60 are fixed to and extend radially from the shaft 52 so as to allow rotation of each disks 60 between a pair of stationary blades 61 which protrude into grinding chambers 51A and 51B.

The blades 61 are mounted to removable circular sleeve bands 63 which are wrapped around the housing 50 over the sleeves 57 and bolted in place to prevent leakage of the slurry mixture and to secure the blades 61 in a stationary position for grinding. The sleeve bands are removable for maintenance access into the housing 50.

Each disk 60 and each blade 61 are spaced in relation to each other in close proximity so as to allow only a very small gap between each disk 60 and each stationary blade 61. The shearing capacity of the disk and blade combination is improved by their close proximity.

The rotating disks 60 and the sleeve bands 63 having stationary blades 61 together comprise the sleeve grinders 65.

A vertical array of sleeve grinders 65 are spaced at intervals along the grinding chambers 51A and 51B. Ideally, three sleeve grinders 65 are placed in each grinding chamber as shown in FIG. 2. The number of sleeve grinders 65 in each chamber may vary depending upon the size of the grinding mill and the nature of the solids particles being circulated in the slurry mixture.

Also shown in FIG. 2 within the housing 50 is a series of impeller chambers, 55A, 55B and 55C. Within each impeller chamber are impellers 59 mounted to the shaft 52 to lift and pump the solids-slurry mixture through the mill inlet 21, through the grinding chambers 51A and 51B, and eventually through the mill exit port 23A to conduit 23 for re-circulation of the solids-slurry mixture through the mill 20.

In the preferred embodiment the impeller chambers are located between each grinding chamber. Impeller 59 of the bottom impeller chamber 55C is positioned in the preferred embodiment even with the highest point of the of the inlet port 21 of the housing 50 and impeller 59 of the upper impeller chamber 55A is located just below the outlet port 23A of the housing 50.

Figure 3:
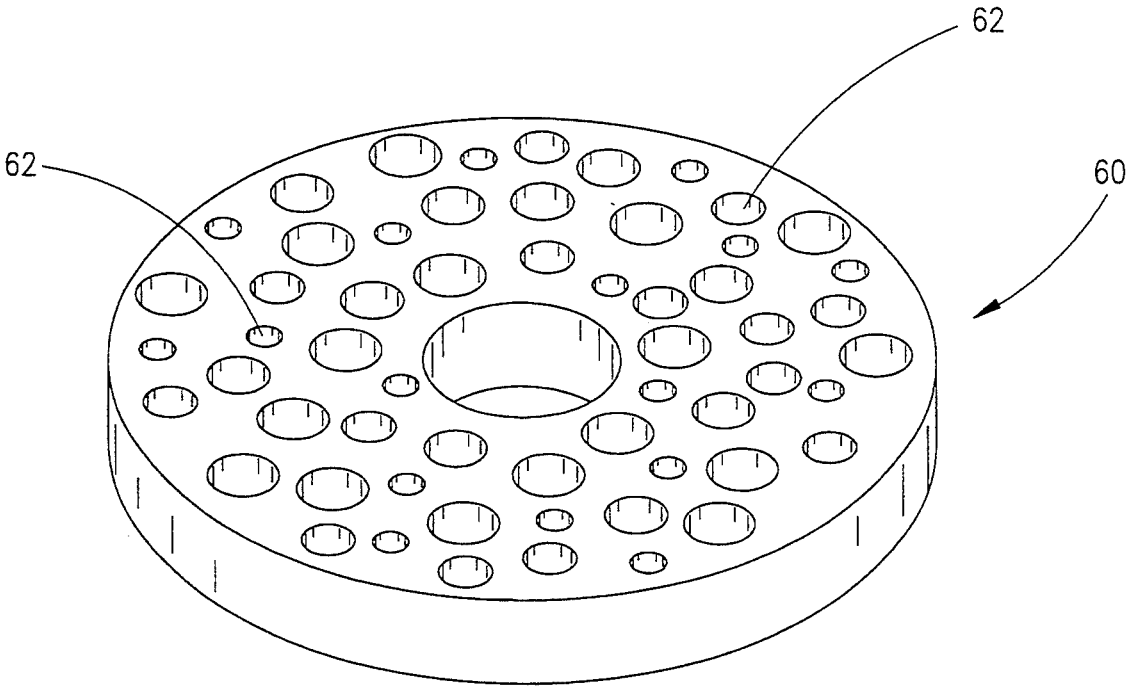
FIG. 3 is a top perspective view of the rotating grinding disk.

In FIG. 3 there is shown a top perspective view of a typical disk 60. A plurality of circulation holes 62 penetrate each disk 60. The circulation holes 62 ideally range from 0.25 to 1.0 inches in diameter to allow flow of the slurry mixture through the holes 62 as the disks rotate for slurry circulation and to hold the solids particles suspended in the slurry mixture for engagement with the stationary blade 61 for grinding and particle size reduction.

It is thought that the apparatus and method for the reduction and classification of solids particles and many of its intended advantages will be understood from the foregoing description and it will be apparent that various changes may be made in form, construction, and arrangement of the parts thereof without departing from the spirit and scope of the invention or sacrificing all of its material advantages, the form herein before described being merely illustrative of the preferred embodiment of the invention.

We claim:

1. A system for reducing the size of solids particles suspended in a viscous liquid and for classifying said suspended solids particles by size comprising:

(a) a receiving tank for receiving a quantity of said solids particles for size reduction and classification along with a quantity of said viscous liquid, (b) means for mixing said viscous liquid together with said solids particles to form a slurry of suspended solids particles, (c) a plurality of fluid mills for pumping said slurry and for reducing the size of said slurry suspended solids particles, said fluid mills having a slurry inlet, a plurality of rotating perforated disks in combination with a plurality of stationary blades, at least one impeller and a slurry outlet;

(d) an initial reducing tank having at least one of said fluid mills;

(e) a first conduit for transporting said slurry from said receiving tank to said initial reducing tank;

(f) an intermediate reducing tank, said intermediate reducing tank having grinding means for receiving said slurry from said initial reducing tank, screening means for removal of solids particles in excess of a predetermined size from said slurry, means for delivering said excessively sized solids particles to said grinding means, and at least one of said fluid mills;

(g) a second conduit for transporting said slurry from said initial reducing tank to said intermediate reducing tank;

(h) a holding tank, said holding tank having additional screening means for removing solids particles in excess of a predetermined size from said slurry, means for returning said excessively size solids particles to said intermediate reducing tank, and at least one of said fluid mills; and (i) a third conduit for transporting said slurry from said intermediate reducing tank to said holding tank screening means.

2. A system for reducing the size of solids particles suspended in a viscous liquid and for classifying said suspended solids particles by size comprising:

(a) a receiving tank for receiving a quantity of said solids particles for size reduction and classification along with a quantity of said viscous liquid, said receiving tank having mixing means for mixing said solids particles and said viscous liquid together to form a slurry of suspended solids particles, first screening means for removing solids particles in excess of a predetermined size from said slurry, and means for removing ferrous metals from said slurry;

(b) a plurality of fluid mills for pumping said slurry and for reducing the size of said slurry suspended solids particles, said fluid mills having a slurry inlet, a plurality of rotating perforated disks in combination with a plurality of stationary blades, at least one impeller and a slurry outlet;

(c) a first reducing tank having at least one of said fluid mills for reducing the size of said solids particles in said slurry and for circulating said slurry within said first reducing tank;

(d) a first slurry conduit for transporting said slurry from said receiving tank to said first reducing tank;

(e) a second reducing tank, said second reducing tank having grinding means for receiving said slurry from said first reducing tank, a second screening means to receive said slurry from said grinding means for removal of solids particles in excess of a predetermined size from said slurry and for delivering said excessively sized solids particles to said grinding means for re-grinding and re-screening so as to allow only a slurry having solids particles of a predetermined size into said second reducing tank, and at least one of said fluid mills for reducing and circulating said slurry within said second reducing tank;

(f) a second slurry conduit for transporting said slurry from said first reducing tank to said second reducing tank;

(g) at least one holding tank, said holding tank having a third screening means for removing solids particles in excess of a predetermined size from said slurry and for returning said excessively sized particles to said second reducing tank for additional circulation and size reduction, and at least one of said fluid mills for circulating said slurry within said holding tank; and (h) a third slurry conduit for transporting said slurry from said second reducing tank to said third screening means in said holding tank.

3. A solids reduction and classification system as recited in claims 1 or 2 wherein said viscous liquid is a mixture of bentonite and water.

4. A solids reduction and classification system as recited in claim 2 wherein said second screening means is a circular rotating screen.

5. A solids reduction and classification system as recited in claim 4 wherein said third screening means is a shaker-type screen classifier.

6. A solids reduction and classification system as recited in claim 2 wherein said means for separating ferrous metals from said slurry is a magnet.

7. A mill for pumping liquid suspended solids and for simultaneously reducing the size of said solids comprising:

(a) a chamber;

(b) an inlet to said chamber for said liquid suspended solids;

(c) a vertical horizontally rotatable shaft mounted within said chamber;

(d) a plurality of impellers mounted to said shaft above said inlet for lifting and pumping said liquid suspended solids;

(e) a plurality of disks mounted to and extending radially from said shaft above said impellers, said disks having a plurality of perforations;

(f) a plurality of stationary blades mounted within said chamber, said stationary blades being mounted parallel to and in close proximity with said perforated disks;

(g) an outlet from said chamber for said liquid suspended solids above said disks; and (h) means for rotating said shaft.

8. A mill for pumping liquid suspended solids and for simultaneously reducing the size of said solids as recited in claim 7 wherein said perforations in said disks are variably sized.

9. A mill for pumping liquid suspended solids and for simultaneously reducing the size of said solids as recited in claim 7 wherein said perforations in said disks range from 0.25 inches to 0.75 inches.

10. A mill for pumping liquid suspended solids and for simultaneously reducing the size of said solids as recited in claim 7 wherein said disks are situated in close proximity between a pair of said blades.

11. A mill for pumping liquid suspended solids and for simultaneously reducing the size of said solids as recited in claim 7 wherein said disks, blades and impellers are arranged in a vertical array.

12. A mill for pumping liquid suspended solids and for simultaneously reducing the size of said solids as recited in claim 7 wherein said means for rotating said shaft is an electric motor.

13. A mill for pumping liquid suspended solids and for simultaneously reducing the size of said solids as recited in claim 7 wherein said rotatable shaft is rotated at high speeds.

14. A mill for grinding and pumping liquid suspended solids comprising:

(a) a housing with an upper end and a lower end, said housing having a plurality of grinding chambers and a plurality of impeller chambers arranged in a vertical array between said lower end and said upper end of said housing, said grinding chambers being interposed between said impeller chambers so as to have one of said impeller chambers at said lower end of said housing and one of said impeller chambers at said upper end of said housing, each of said grinding chambers and said impeller chambers having a passage from one to the other, and said housing having openings into each of said grinding chambers;

(b) an upper bearing at the upper end of said housing and a lower bearing at the lower end of said housing;

(c) a rotatable shaft mounted vertically within said housing between said upper bearing and said lower bearing;

(d) at least one impeller mounted to said shaft within each of said impeller chambers;

(e) an inlet through said housing to said lower impeller chamber for said liquid;

(f) an outlet from said upper impeller chamber through said housing for said liquid;

(g) a plurality of perforated disks mounted to said shaft so as to have at least one of said disks within each of said grinding chambers;

(h) a plurality of bands to cover said openings into said grinding chambers, each of said bands having a pair of blades extending into said grinding chamber to correspond with each of said disks, each blade of said pair being spaced vertically apart from the other so as to form a sleeve to receive said corresponding disk;

(i) means for mounting said bands to said housing; and (j) means for rotating said shaft.

15. A mill for pumping and grinding liquid suspended solids as recited in claim 14 wherein said disks perforations vary in size.

16. A mill for pumping and grinding liquid suspended solids as recited in claim 15 wherein said means for mounting said bands to said housing includes bolting.

17. A mill for pumping and grinding liquid suspended solids as recited in claim 15 wherein said means for rotating said shaft is an electric motor.

18. A mill for pumping and grinding liquid suspended solids as recited in claim 14 wherein said disks perforations range in size from 0.25 inches to 0.75 inches.

19. A mill for pumping and grinding liquid suspended solids as recited in claim 14 wherein said outlet from said upper impeller chamber is above said impeller of said upper impeller chamber.

20. A mill for pumping and grinding liquid suspended solids as recited in claim 14 wherein said inlet to said lower impeller chamber is below said impeller of said lower impeller chamber.

* * * * *